US012319492B2

(12) United States Patent
Kim et al.

(10) Patent No.: US 12,319,492 B2
(45) Date of Patent: Jun. 3, 2025

(54) FOLDABLE CONTAINER FOLDING DEVICE AND AUTOMATIC FOLDING SYSTEM COMPRISING SAME

(71) Applicant: KOREA RAILROAD RESEARCH INSTITUTE, Uiwang-si (KR)

(72) Inventors: Hag Seoung Kim, Hwaseong-si (KR); Suk Lee, Seoul (KR); Young Joo Kim, Anyang-si (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 814 days.

(21) Appl. No.: 17/275,501

(22) PCT Filed: Jul. 29, 2019

(86) PCT No.: PCT/KR2019/009377
§ 371 (c)(1),
(2) Date: Mar. 11, 2021

(87) PCT Pub. No.: WO2020/054969
PCT Pub. Date: Mar. 19, 2020

(65) Prior Publication Data

US 2022/0033176 A1 Feb. 3, 2022

(30) Foreign Application Priority Data

Sep. 12, 2018 (KR) ..... 10-2018-0109232

(51) Int. Cl.
*B65D 88/52* (2006.01)

(52) U.S. Cl.
CPC ..... *B65D 88/524* (2013.01)

(58) Field of Classification Search
CPC . B31B 50/004; B31B 50/0042; B31B 50/064; B31B 50/26; B31B 50/42;
(Continued)

(56) References Cited

U.S. PATENT DOCUMENTS 4,553,954 A * 11/1985 Sewell ..... B31B 50/006 493/122
7,287,360 B2 * 10/2007 Makar ..... B31B 50/00 53/136.1

(Continued)

FOREIGN PATENT DOCUMENTS

EP 3296232 3/2018
JP 3003652 10/1994

(Continued)

OTHER PUBLICATIONS

European Search Report—European Application No. 19860733.5 issued on Apr. 12, 2022 citing EP 3296232, KR 2017-0001333, KR 2015-0078101, and KR 2016-0146027.

(Continued)

*Primary Examiner* — Sameh Tawfik
(74) *Attorney, Agent, or Firm* — CANTOR COLBURN LLP

(57) ABSTRACT

Provided is a foldable container automatic folding system including: a transfer unit on which the foldable container is mounted and which transfers the foldable containers; an introduction unit in which fasteners fastened to the foldable container are disassembled at a position where the transfer unit starts a folding operation; an operation unit which includes foldable container folding device that are disposed adjacent to the introduction unit and each located at front and rear surfaces of the foldable container to fold and unfold the foldable container; a locking unit which is disposed adjacent to the operation unit, stacks the foldable containers that are folded after the folding operation is completed by the operation unit, and performs a locking operation to make the folded foldable containers into one bundle unit; and a discharge unit in which a plurality of foldable containers wait to be transported and stored.

9 Claims, 29 Drawing Sheets

(58) Field of Classification Search
CPC ..... B31B 50/76; B31B 50/78; B31B 50/787; B31F 1/0003; B31F 1/0006; B65D 88/524
USPC ..... 493/162
See application file for complete search history.

(56) References Cited

U.S. PATENT DOCUMENTS

| | | | | |
|---|---|---|---|---|
| 8,128,547 | B2 * | 3/2012 | Graham | B31B 50/78 53/381.1 |
| 11,040,511 | B2 * | 6/2021 | Davidson | B31B 50/262 |
| 11,173,686 | B2 * | 11/2021 | Chu | B31B 50/07 |
| 11,780,197 | B2 * | 10/2023 | Johnson | B31B 50/046 493/132 |
| 2006/0100078 | A1 * | 5/2006 | Makar | B31B 50/00 493/70 |
| 2006/0117714 | A1 * | 6/2006 | Draghetti | B65B 5/024 53/566 |
| 2009/0291816 | A1 * | 11/2009 | Gebhardt | B65B 43/305 493/313 |
| 2010/0292063 | A1 | 11/2010 | Chawla et al. | |
| 2014/0179501 | A1 * | 6/2014 | Akama | B31B 50/262 493/162 |
| 2015/0031517 | A1 * | 1/2015 | Cavazza | B31B 50/062 493/162 |
| 2018/0171685 | A1 | 6/2018 | Kim et al. | |
| 2019/0160774 | A1 * | 5/2019 | Langen | B31B 50/0042 |
| 2019/0263545 | A1 * | 8/2019 | Yokota | B65B 43/54 |
| 2020/0254707 | A1 * | 8/2020 | Iwasa | B31B 50/004 |

FOREIGN PATENT DOCUMENTS

| | | |
|---|---|---|
| JP | 3030297 | 10/1996 |
| KR | 20140123496 | 10/2014 |
| KR | 20150078101 | 7/2015 |
| KR | 20160146027 | 12/2016 |
| KR | 20170001333 | 1/2017 |
| KR | 101754192 | 7/2017 |
| KR | 101770607 | 8/2017 |
| WO | 2009109514 | 9/2009 |
| WO | 2016200195 | 12/2016 |

OTHER PUBLICATIONS

Developing the Foldable Container Saving 300 billion Won per Year in Logistical Costs, Electronic Times etnews, Jan. 22, 2017, retrieved from <URL: http://www.etnews.com/20170122000033?m=1>.

Foldable Container, Saving 6,000 billion won?, Dailian, Jan. 22, 2017, retrieved from <URL: http://www.dailian.co.kr/news/view/607970>.

International Search Report—PCT/KR2019/009377 dated Oct. 31, 2019.

* cited by examiner

FOLDABLE CONTAINER FOLDING DEVICE AND AUTOMATIC FOLDING SYSTEM COMPRISING SAME

BACKGROUND

1. Technical Field

The present disclosure relates to a foldable container folding device and automatic folding system comprising same.

2. Related Art

In general, a container is installed with beams of four corners as supports, and panels each having a certain area are mutually fastened and assembled on six surfaces between the supports, that is, front, rear, left, right, top, and bottom surfaces with fastening means such as welding or rivets to form a space inside.

Also, a foldable container is known that transports and unloads cargo therein, and then separates the cargo from a vehicle or a ship to fold an empty container without cargo to be stored or transported.

A closing and opening operation for folding and unfolding such a foldable container is performed by generally using a reach stacker, a forklift, or the like.

However, the reach stacker or the forklift is a logistics equipment that handles containers, and it is not possible to perform the opening and closing operation smoothly by stably holding the foldable container in accordance with the order and characteristics of the foldable container opening and closing operation. There is a problem in that foldable container parts are damaged due to the occurrence of misalignment and distortion.

In addition, there is a problem in that the container is damaged or it takes a long time to open and close the foldable container according to a skill level of a driver of the reach stacker or the forklift.

In addition, there is a problem in that an enormous cost for opening and closing of the foldable container is required due to the use of the expensive reach stacker or forklift.

In this regard, in US 2010-0292063 A1 (title of the invention: device and method for folding and unfolding a foldable transport container), a configuration is disclosed which includes a plurality of actuators; a moving portion driven by an actuator that folds at least one side of a container; an arm driven by the actuator that folds a top and a base of the container; a structure to which the actuator, the moving portion, and the arm are fixed.

SUMMARY

The present application is to solve the problems of the prior art described above, and an object of the present disclosure is to provide a foldable container folding device in which the safety and efficiency of a folding and unfolding operation of the foldable container are improved.

In addition, another object of the present disclosure is to provide a foldable container automatic folding system in which a foldable container is automatically folded and unfolded by minimizing the use of manpower at each step.

However, the technical problem to be achieved by the present embodiment is not limited to the technical problems as described above, and other technical problems may exist.

As technical means for solving the technical problems, a foldable container folding device according to a first aspect of the present application includes: a main body; an upper fixing unit provided on the upper portion of the main body and fixing the upper portion of the foldable container; front and rear opening/closing units provided on the upper portion of the main body to open and close a front panel or a rear panel of the foldable container; and an elevation opening/closing unit for elevating the upper panel and a side panel of the foldable container by elevating the upper fixing unit. The front and rear opening/closing unit includes a front and rear panel fastening rod having one end connected to a ring of the front panel or the rear panel and the other end rotatably coupled; a push portion for pushing the front panel or the rear panel toward the inside of the foldable container; a side support extending in a lateral direction from the push portion; a wire connected to an upper end of the front and rear panel fastening rod; and a wire motor for winding or unwinding the wire.

On the other hand, a foldable container automatic folding system according to a second aspect of the present application includes: a transfer unit on which the foldable container is mounted and which transfers the foldable containers; an introduction unit in which fasteners fastened to the foldable container are disassembled at a position where the transfer unit starts a folding operation; an operation unit which includes foldable container folding device that are disposed adjacent to the introduction unit and each located at front and rear surfaces of the foldable container to fold and unfold the foldable container; a locking unit which is disposed adjacent to the operation unit, stacks the foldable containers that are folded after the folding operation is completed by the operation unit, and performs a locking operation to make the folded foldable containers into one bundle unit; and a discharge unit in which a plurality of foldable containers in the bundle unit made in the locking unit wait to be transported and stored.

On the other hand, a method of folding a foldable container according to a third aspect of the present application includes: a step of disassembling fasteners fastened to the foldable container which is transferred to an introduction unit; a step of transferring the foldable container to an operation unit; a step of folding the foldable container in the operation unit; a step of transferring the foldable container from the operation unit to a locking unit; a step of making a plurality of folded foldable containers into one bundle unit by inserting a container locking device into a corner fitting of the foldable container in the locking unit; and a step of transferring the folded foldable containers of the bundle unit made in the locking unit, to a discharge unit.

According to the above-described problem solving means of the present application, the foldable container automatic folding system may automatically fold the foldable container by minimizing the use of manpower at each step, so that safety and efficiency may be significantly improved.

DETAILED DESCRIPTION OF THE EMBODIMENTS

Figure 1:
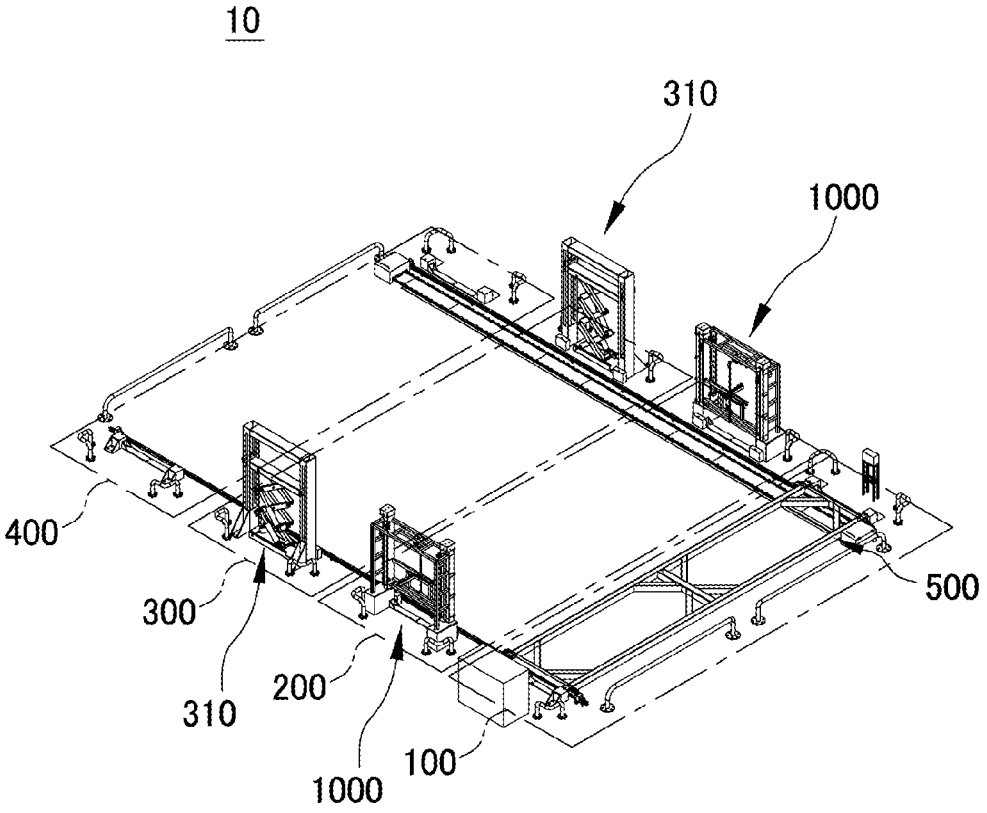
FIG. 1 is a perspective view of a foldable container automatic folding system according to an embodiment of the present disclosure.

Hereinafter, embodiments of the present application will be described in detail with reference to the accompanying drawings so that those of ordinary skill in the art may easily implement the present application. However, the present application may be implemented in various different forms and is not limited to the embodiments described herein. In the drawings, parts not related to the description are omitted in order to clearly describe the present application, and similar reference numerals are attached to similar parts throughout the specification.

Throughout this specification, when a part is said to be "connected" with another part, this includes not only a case that it is "directly connected" but also a case that it is "electrically connected" with another element interposed therebetween.

In the entire specification of the present application, when a member is located on another member, this includes not only a case in which a certain member is in contact with another member, but also a case in which another member exists between the two members.

In the entire specification of the present application, when a certain part "includes" a certain component, it means that other components may be further included rather than excluding other components unless specifically stated to the contrary. The terms "about", "substantially", or the like to an extent used throughout this specification are used at or close to the numerical value when manufacturing and material tolerances specific to the stated meaning are presented, and are used to prevent unreasonable use of the stated disclosure, in which accurate or absolute numerical values are used to assist the understanding of the present application, by unscrupulous infringers. As used throughout the specification of the present application, the term "step to" or "step of" does not mean "step for".

The present application relates to a foldable container folding device and an automatic folding system including the same.

On the other hand, the detailed configuration of a foldable container and a locking device for a container to be described below, and an operation method thereof are introduced in Korean patent registration No. 10-1754192 (title of the disclosure: foldable container) and No. 10-1770607 (title of the disclosure: locking device for container), thereby referring to the relevant document for further explanation. In addition, the foldable container folding device of the present disclosure may be a device for folding or unfolding the foldable container disclosed in Korean patent registration No. 10-1754192, but is not limited thereto.

Figure 6:
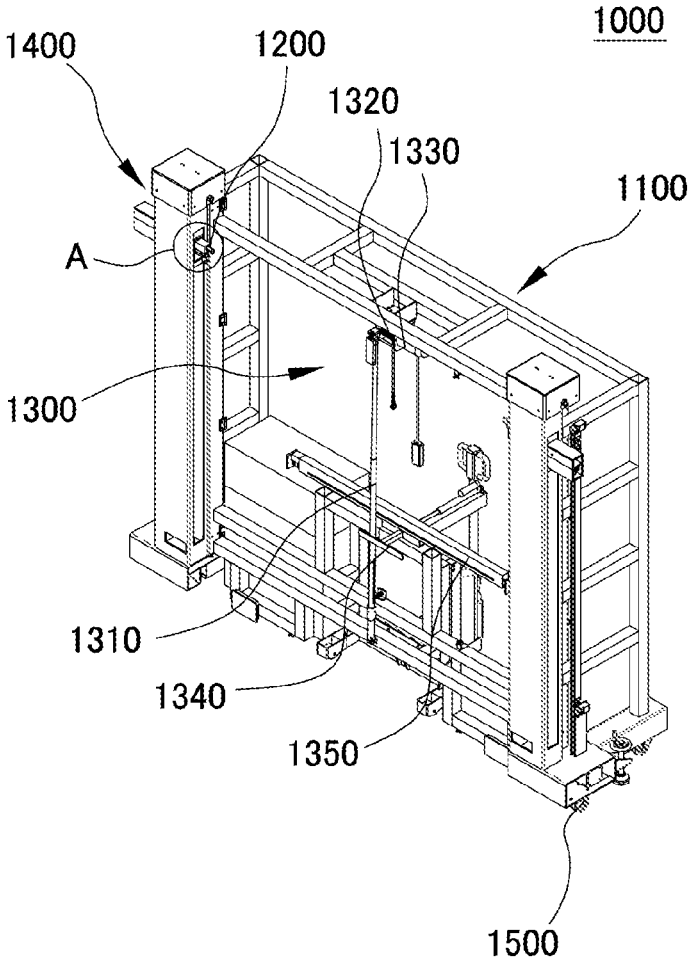
FIG. 6 is a perspective view of a foldable container folding device according to an embodiment of the present disclosure.

In addition, a foldable container folding device 1000 is fixed to the ground and a foldable container 20 is moved to a place where the foldable container folding device 1000 is located, so that the foldable container 20 may be folded or unfolded, but is not limited thereto. Instead, as illustrated in FIG. 6, by providing wheels 1500 at a lower portion of a main body 1100, the foldable container folding device 1000 is moved to a place where the foldable container 20 is located, and the foldable container 20 may be folded or unfolded.

Prior to describing a foldable container automatic folding system 10, the foldable container 20 will be described briefly.

Figure 5:
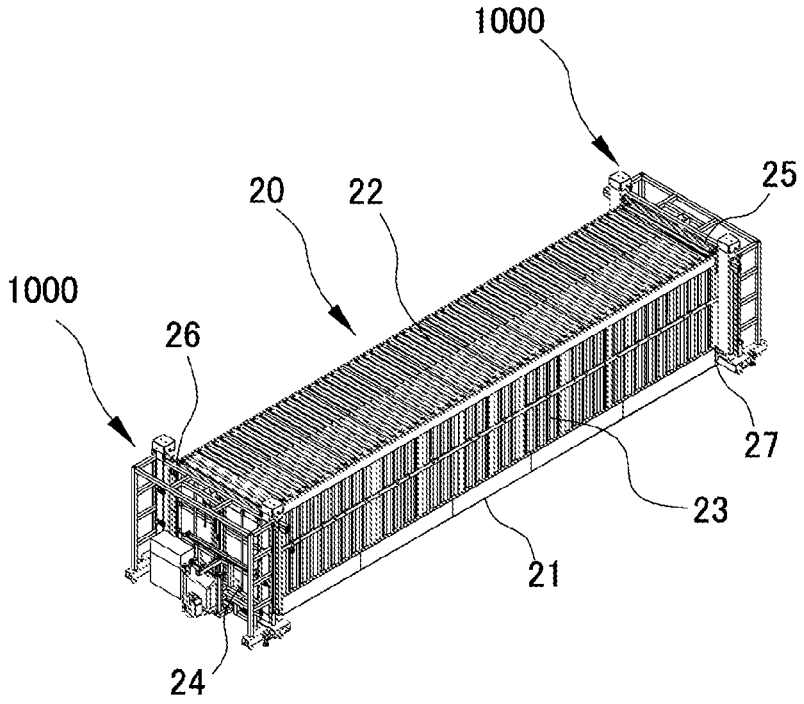
FIG. 5 is a view in which foldable container movable folding and unfolding devices according to an embodiment of the present disclosure are located at front and rear surfaces of the foldable container, respectively.

Referring to FIG. 5, the foldable container 20 includes a lower panel 21; an upper panel 22 provided parallel to the lower panel 21; a side panel 23 which has upper and lower ends each rotatably connected to the upper panel 22 and the lower panel 21 in a longitudinal direction, and is configured to be folded in an inward direction of the foldable container 20; and a front panel 24 and a rear panel 25 which are rotatably connected in a width direction of the lower panel 21. In addition, an upper corner fitting 26 is located at each corner of the upper panel 22, and a lower corner fittings 27 is located at each corner of the lower panel 21. As described above, the longitudinal direction may be the 8 o'clock direction and the 2 o'clock direction of FIG. 5, and the width direction may be the 4 o'clock direction and the 10 o'clock direction of FIG. 5.

Hereinafter, with reference to FIG. 1, the foldable container automatic folding system 10 according to an embodiment of the present application will be described briefly.

The foldable container automatic folding system 10 includes an introduction unit 100 in which the foldable container 20 is introduced to be mounted and fasteners fastened to the foldable container 20 are disassembled for starting the folding operation; an operation unit 200 which includes foldable container folding device 1000 that are disposed adjacent to the introduction unit 100 and each located at the front and rear surfaces of the foldable container 20 to fold and unfold the foldable container 20; a locking unit 300 which stacks the foldable containers 20 that are folded after the folding operation is completed to be made into one bundle unit; a discharge unit 400 in which a plurality of foldable containers 20 in the bundle unit made in the locking unit 300 waits to be transported and stored; and a transfer unit 500 that transfers the foldable containers 20.

Figure 2A:
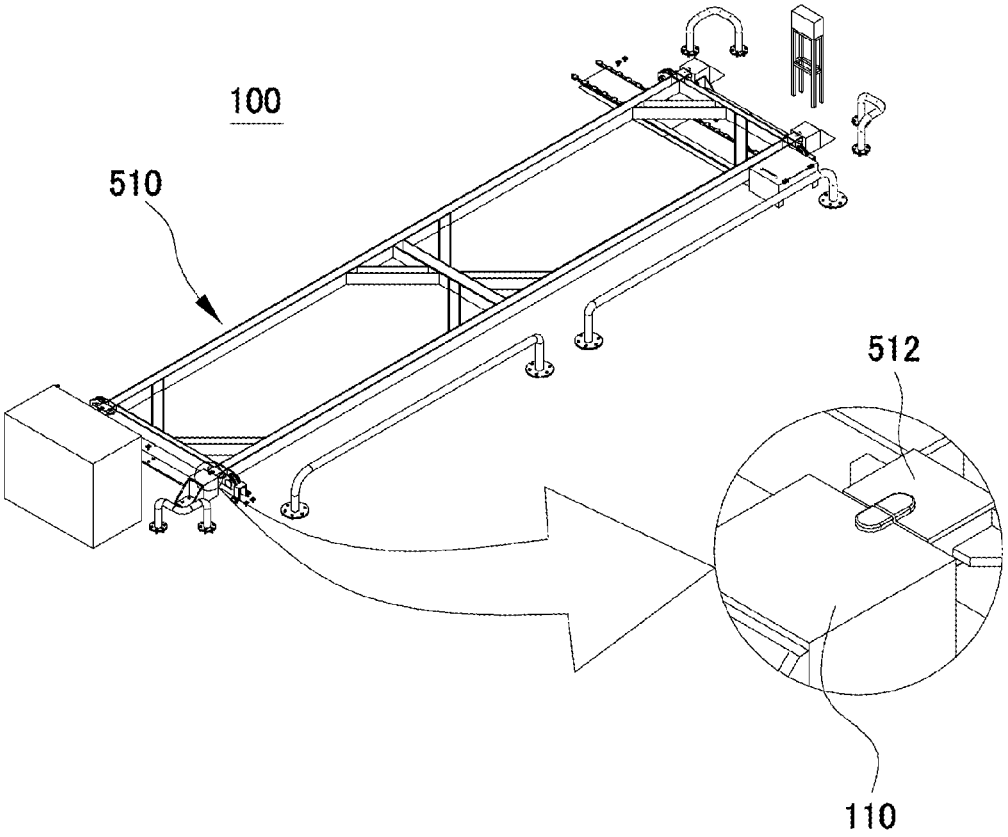
FIGS. 2A and 2B are a view for explaining an introduction unit according to an embodiment of the present disclosure.
Figure 2B:
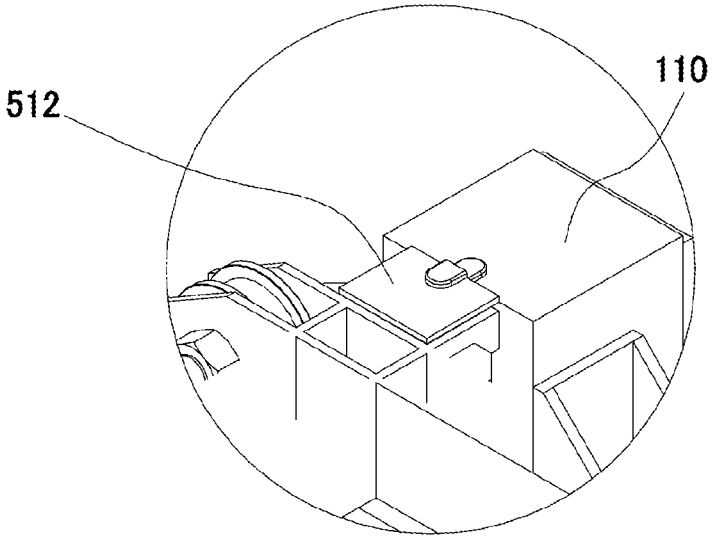

Referring to FIGS. 1 and 2, the introduction unit 100 is located at the rightmost side of the foldable container automatic folding system 10, and the foldable container 20 may be moved and located by using a forklift or reach stacker. In addition, in the introduction unit 100, an operator may disassemble fasteners such as bolts inside and outside the foldable container 20, which are coupled to maintain an unfolded state of the foldable container 20. That is, the side panel 23 is divided into an upper side panel and a lower side panel, and the fasteners such as bolts are coupled to maintain the coupled state. The container 20, in which the fasteners are disassembled, may be transferred from the introduction unit 100 to the operation unit 200 by using the transfer unit 500. In other words, the foldable container 20 is located such that a part of the outside of the lower corner fitting 27 is mounted on the support 110 of the introduction unit 100, and the rest of the lower corner fitting 27 may be located on a seating portion 512. In addition, referring to FIG. 2B, when transferring the foldable container 20, as the transfer frame 510 is moved by a frame lifting/lowering driver by a predetermined distance in the upward direction, the seating unit 512 is located above the support 110. Therefore, it is possible to smoothly transfer the foldable container 20.

Figure 3:
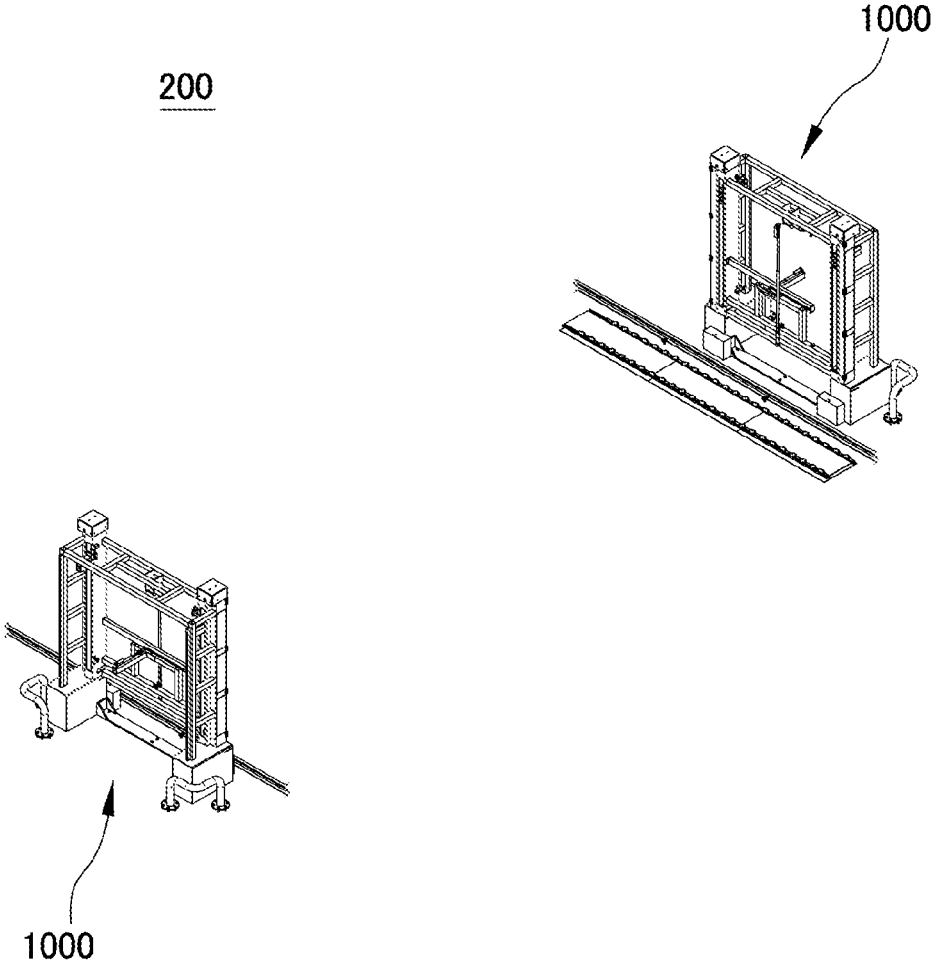
FIG. 3 is a view for explaining an operation unit according to an embodiment of the present disclosure.

Referring to FIG. 1, the operation unit 200 may be located on the left side of the introduction unit 100, and the foldable container 20 in which the fasteners are disassembled is moved by the transfer unit 500 to be located in the operation unit 200. In addition, with reference to FIG. 3, in the operation unit 200, the foldable container folding device 1000 may be located on the front and rear surfaces of the foldable container 20, respectively. In addition, the operation unit 200 may perform the folding or unfolding operation of the foldable container 20. The above-described foldable container folding device 1000 will be described later in detail.

Figure 4:
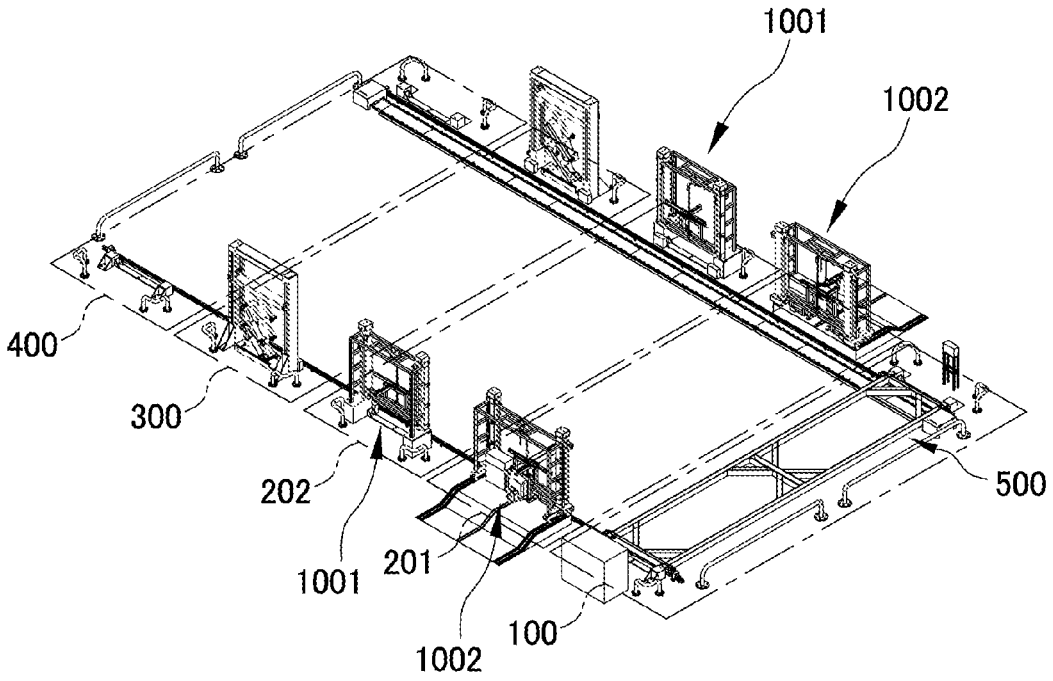
FIG. 4 is a perspective view of a foldable container automatic folding system according to another embodiment of the present disclosure.

Referring to FIG. 4, the foldable container automatic folding system 10 may include a plurality of operation units 201 and 202.

In detail, the operation units 201 and 202 may include a variable operation unit 201 including a moving-type foldable container folding device 1002 that is provided with the wheels 1500 at the lower portion to be movable; and a fixed operation unit 202 including a fixed-type foldable container folding device 1001. In other words, the foldable container automatic folding system 10 is installed in a place where a large number of foldable containers 20 are folded and unfolded, so that the time to make the folded containers in the bundle unit may be reduced. In addition, as illustrated in FIG. 4, the operation unit 200 may include two operation units 200, that is, the variable operation unit 201 and the fixed operation unit 202, but is not limited thereto. The variable operation unit 201 may be further included to provide three or more operation units 200.

Hereinafter, the foldable container folding device 1000 according to an embodiment of the present application will be described with reference to FIGS. 5 to 11.

As illustrated in FIG. 5, the foldable container folding device 1000 are each located on the front and rear surfaces of the foldable container 20, and may fold or unfold the foldable container 20. In addition, the foldable container folding device 1000 is located in the foldable container automatic folding system 10 to fold or unfold the foldable container 20, but is not limited thereto, and may be moved to another place, if necessary, to fold or unfold the foldable container 20. In other words, the foldable container folding device 1000 may be the moving-type foldable container folding device 1002 that is provided with the wheels 1500 under the main body 1100 and is movable.

Referring to FIG. 6, the foldable container folding device 1000 includes the main body 1100; an upper fixing unit 1200 provided at the upper portion of the main body 1100 and fixing the upper portion of the foldable container 20; a front and rear opening/closing unit 1300 provided at the upper portion of the main body 1100, and opening and closing the front panel 24 or the rear panel 25 of the foldable container 20; and an elevation opening/closing unit 1400 for lifting and lowering the upper panel 22 and the side panel 23 of the foldable container 20 by lifting and lowering the upper fixing unit 1200. In addition, a plurality of wheels 1500 are provided under the main body 1100, so that the foldable container folding device 1000 may be easily moved, but is not limited thereto When the foldable container folding device 1000 is used as a fixed type in the foldable container automatic folding system 10, the wheels 1500 are unnecessary and thus the foldable container folding device 1000 may be fixed to the ground to be used.

Figure 7A:
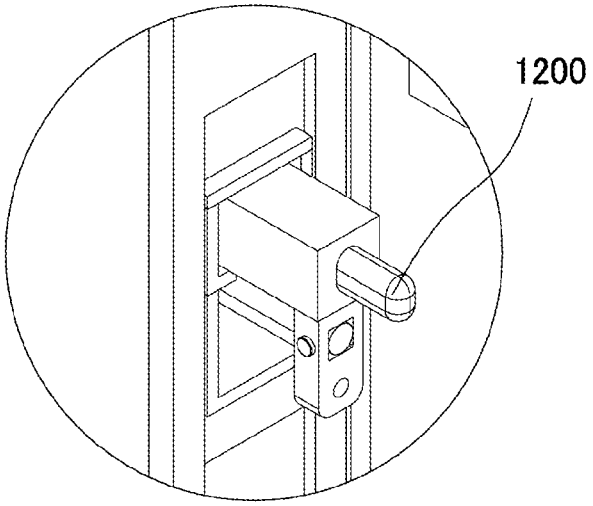
FIGS. 7A and 7B are enlarged views of portion A of FIG. 6.

Referring to FIG. 7A, the upper fixing unit 1200 may be inserted into an insertion groove formed in the upper corner fitting 26 of the foldable container 20. Illustratively, as illustrated in FIG. 7A, the upper fixing unit 1200 is located on the side portion of the foldable container 20 to be inserted into the insertion groove formed on the side portion of the upper corner fitting 26, but is not limited thereto, and may be located in a direction of the front surface or the rear surface of the foldable container 20 to be inserted into an insertion groove formed in the upper corner fitting 26 in the direction of the front surface or the rear surface.

Figure 7B:
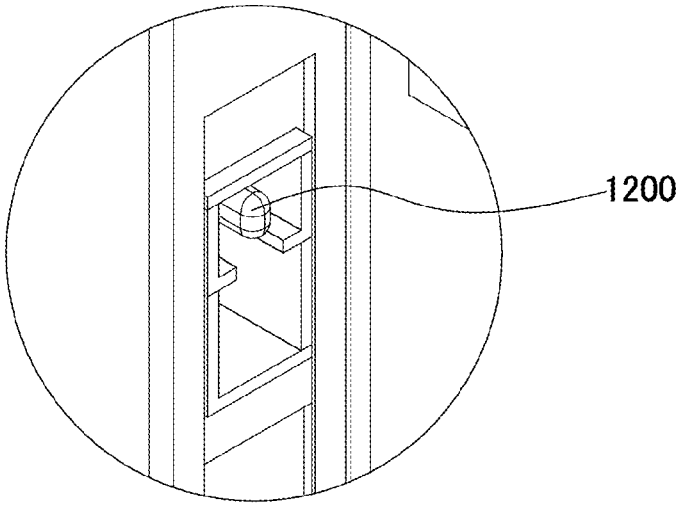

In addition, the upper fixing unit 1200 may be moved in the longitudinal direction. In other words, as illustrated in FIG. 7B, the upper fixing unit 1200 may be located inside the elevation opening/closing unit 1400, and when in use, as illustrated in FIG. 7A, it may protrude to the outside to be inserted into the insertion groove of the upper corner fitting 26. Furthermore, the upper fixing unit 1200 may be moved in the vertical direction by the elevation opening/closing unit 1400 which is described later.

Figure 8:
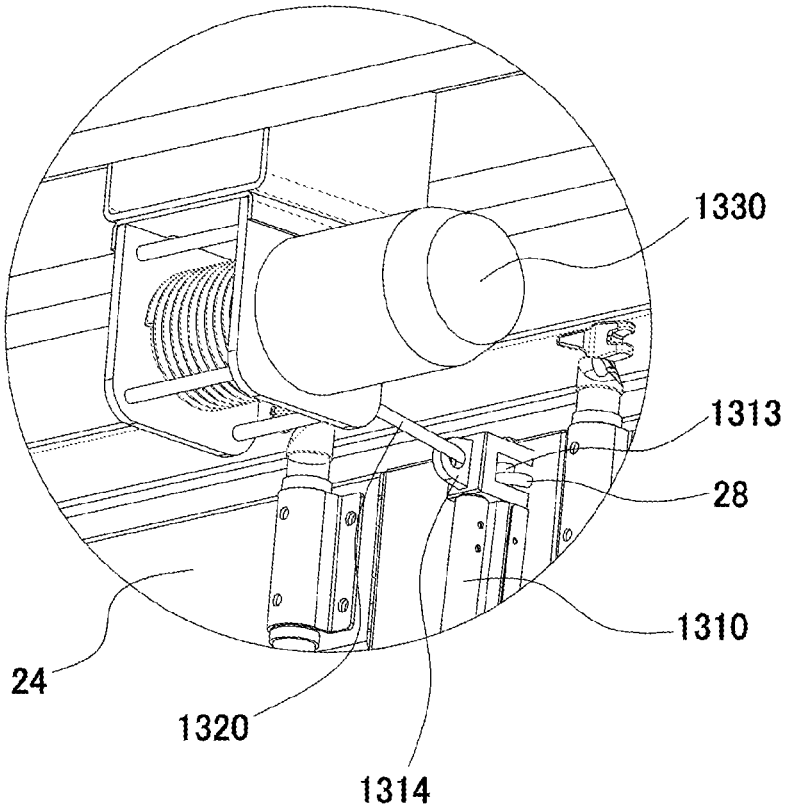
FIG. 8 is a view for explaining a front and rear opening/closing unit according to an embodiment of the present disclosure.

Referring to FIGS. 6 and 8, the front and rear opening/closing units 1300 includes a front and rear panel fastening rod 1310 having one end connected to a ring 28 of the front panel 24 or the rear panel 25 and other end rotatably couple; a wire 1320 connected to an upper end of the front and rear panel fastening rod 1310; and a wire motor 1330 for winding or unwinding the wire 1320.

Figure 9A:
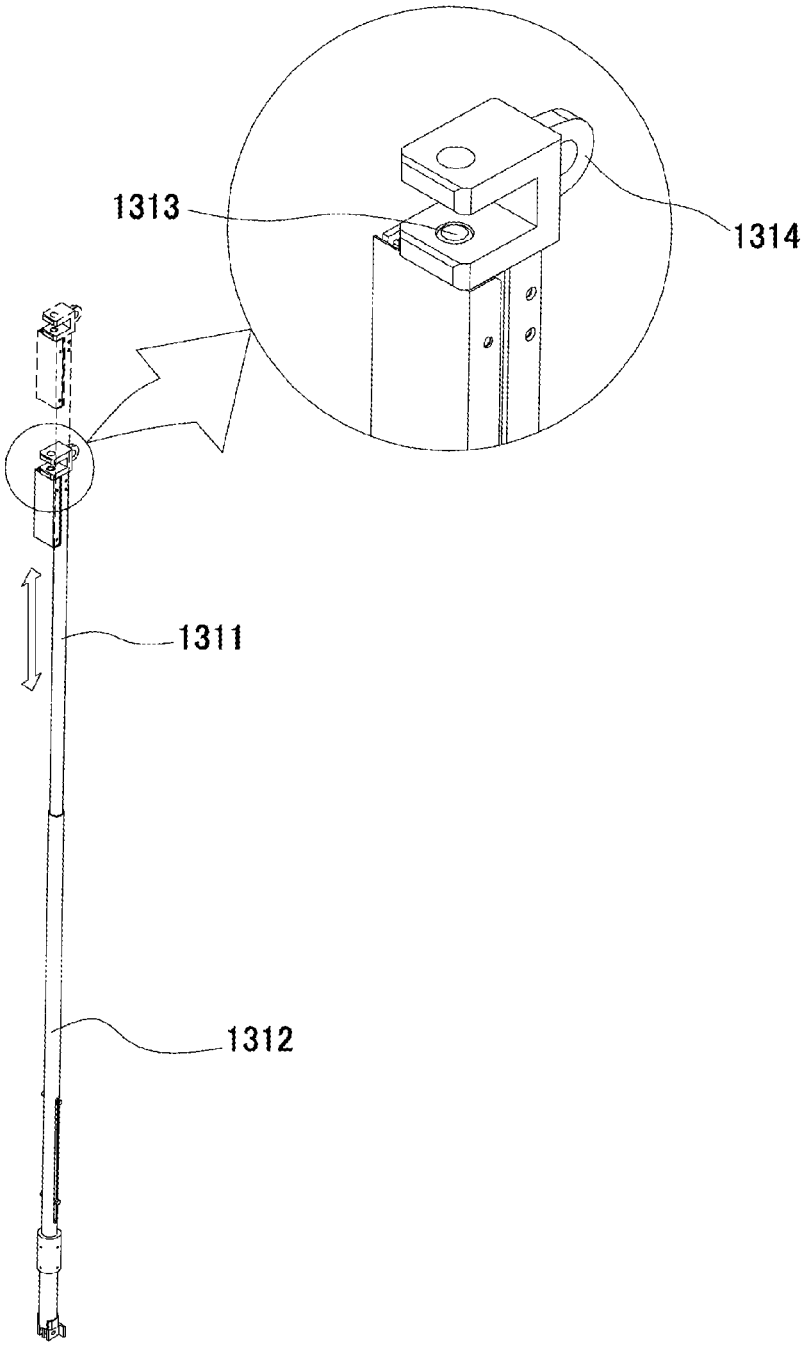
FIGS. 9A and 9B are a perspective view and a partially enlarged view of a front and rear panel fastening rod according to an embodiment of the present disclosure.
Figure 9B:
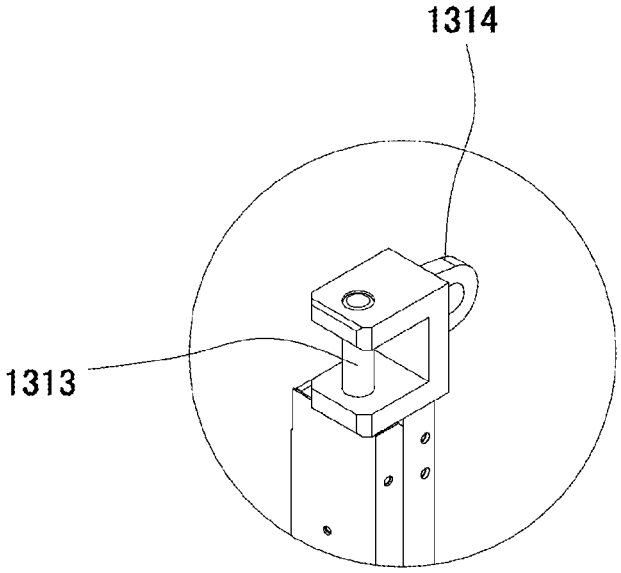

In addition, referring to FIGS. 9A and 9B, the front and rear panel fastening rod 1310 may include an upper fastening rod 1311; a lower fastening rod 1312 into which the upper fastening rod 1311 is inserted therein and of which an lower end is rotatably coupled to the main body 1100; a wire fixing portion 1314 which is located on an upper portion of the upper fastening rod 1311 and to which the wire 1320 is connected; and a ring fixing portion 1313 which is located on the upper portion of the upper fastening rod 1311 and is fixed to the ring 28 of the front panel 24 or the rear panel 25. Illustratively, referring to FIG. 9B, the front and rear panel fastening rod 1310 rotates to be move to the front panel 24 or the rear panel 25, and then moves in the upward direction, thereby being coupled to the ring 28 formed in the front panel 24 or the rear panel 25 to be fixed.

In detail, the ring 28 is formed in each upper portion of the front panel 24 and the rear panel 25, and the ring fixing portion 1313 of the front and rear panel fastening rod 1310 is coupled to the ring 28. The front panel 24 or the rear panel 25 may be folded or unfolded while gradually winding or unwinding the wire 1320 connected to the wire fixing portion 1314 of the front and rear panel fastening rod 1310 by using the wire motor 1330. At this time, the front and rear panel fastening rod 1310 includes the upper fastening rod 1311 and the lower fastening rod 1312 to which the upper fastening rod 1311 is coupled, and may extend or contract in the longitudinal direction. In other words, since a rotation axis of the front and rear panel fastening rod 1310 and a rotation axis of the front panel 24 or the rear panel 25 are different from each other, when the front panel 24 or the rear panel 25 is folded and unfolded, the position of the ring 28 of the front panel 24 or the rear panel 25 is different therefrom. Therefore, the front and rear panel fastening rod 1310 is adjusted in length in the longitudinal direction, so that a fastening state between the ring fixing portion 1313 and the ring 28 may be maintained during operation.

Figure 10:
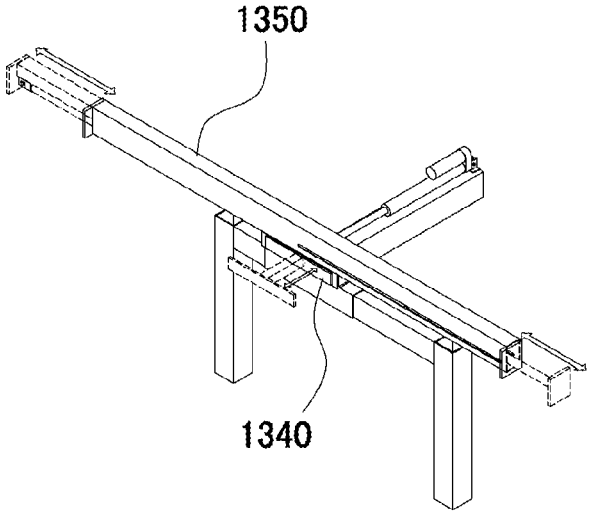
FIG. 10 is a perspective view of a push portion and a side wall support according to an embodiment of the present disclosure.

Referring to FIGS. 6 and 10, the front and rear opening/closing unit 1300 may further include a push portion 1340 which pushes the central portion of the front and rear panels 24 and 25; and a side support 1350 which is formed to extend in the lateral direction from the push portion 1340 and is adjusted in length in the lateral direction.

Specifically, the push portion 1340 may push the central portion of the front panel 24 or the rear panel 25 so that the front panel 24 or the rear panel 25 is rotated to be folded after the front and rear panel fastening rod 1310 is coupled to the front panel 24 or the rear panel 25. At this time, since the front panel 24 or the rear panel 25 is rotatably coupled in the inward direction of the foldable container 20, the push portion 1340 may push the front panel 24 or the rear panel 25 while moving in the inward direction. At this time, the side support 1350 formed to extend from the push portion 1340 in the lateral direction is elongated in the lateral direction to prevent the side panel 23 from being folded in the inward direction. Thus, front and rear panels 24 and 25 rotate in the inward direction of the container 20 without interference with the side panel 23.

In addition, the push portion 1340 and the side support 1350 are not coupled to the main body 1100 and may be in a separate configuration formed to be movable from the main body 1100, but are not limited thereto. In addition, as illustrated in FIG. 10, the side support 1350 may extend or contract in length in the lateral direction.

Figure 11A:
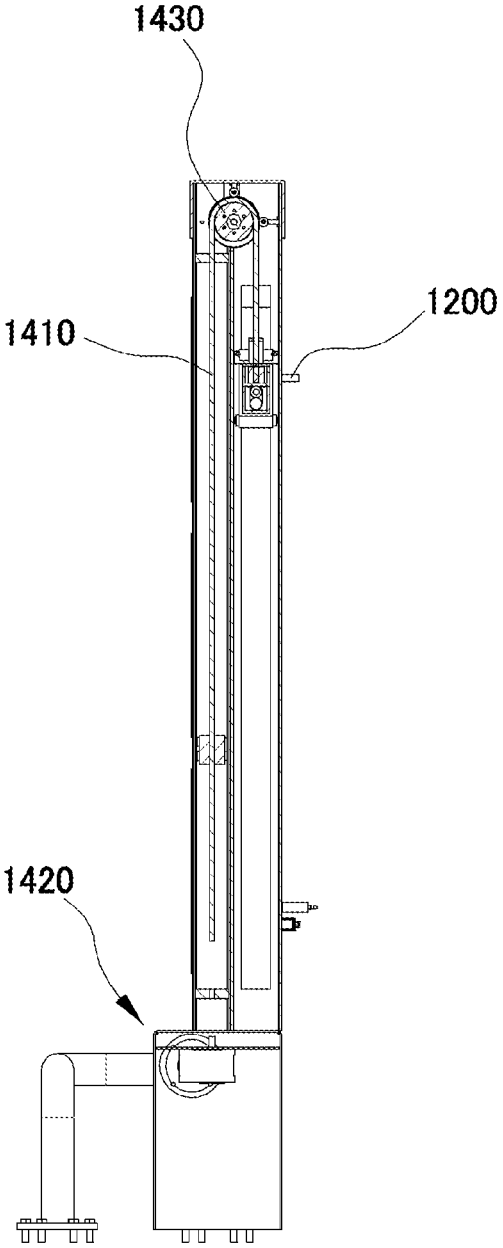
FIGS. 11A and 11B are a view for explaining an elevation opening/closing unit according to an embodiment of the present disclosure.

Referring to FIGS. 6 and 11, the elevation opening/closing units 1400 are respectively located in the right and left sides of the front panel 24 or the rear panel 25, or opposite positions, so that the upper fixing unit 1200 is inserted into the insertion groove of the upper corner fitting 26. In addition, referring to FIG. 11A, the elevation opening/closing unit 1400 may include a pulley 1430 located at the upper portion inside the main body 1100; an elevation wire 1410 of which one end is connected to the upper fixing unit 1200 via the pulley 1430; and an elevation driver 1420 which is located at the lower portion of the main body 1100 and winds or unwinds the elevation wire 1410. In other words, the upper fixing unit 1200 may be connected to the elevation wire 1410 to be moved by the elevation driver 1420 in the vertical direction. In detail, when the upper panel 22 is lowered in the downward direction, the elevation driver 1420 is driven, and the elevation wire 1410 connected to the elevation driver 1420 moves in the upward direction. The elevation wire 1410 connected to the upper fixing unit 1200 is moved by the pulley 1430 in the downward direction and thereby, the upper panel 22 may be lowered.

Figure 11B:
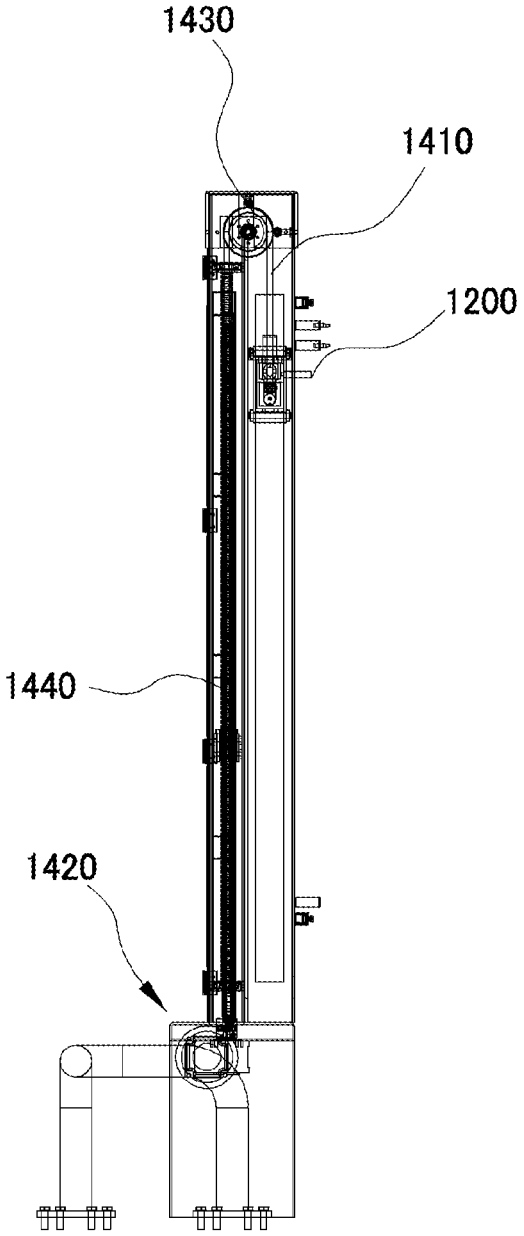

In addition, referring to FIG. 11B, the elevation opening/closing unit 1400 may further include a ball screw 1440 which is rotated by the elevation driver 1420, is connected to the elevation wire 1410, and lifts and lowers the upper fixing unit 1200 through the elevation wire 1410 the pulley 1430. Illustratively, the ball screw 1440 has a thread formed on an outer circumferential surface, and the other end of the wire 1410 may be connected thereto. As the elevation driver 1420 is driven, the ball screw 1440 moves in the vertical direction. Thus, the upper fixing unit 1200 may be moved in the vertical direction. In addition, the elevation opening/closing unit 1400 is located inside a pillar frame of the main body 1100 and may be protected from rain, wind, or the like. Hereinafter, a method of folding the foldable container by using the foldable container folding device according to an embodiment of the present disclosure will be described in detail.

Figure 12:
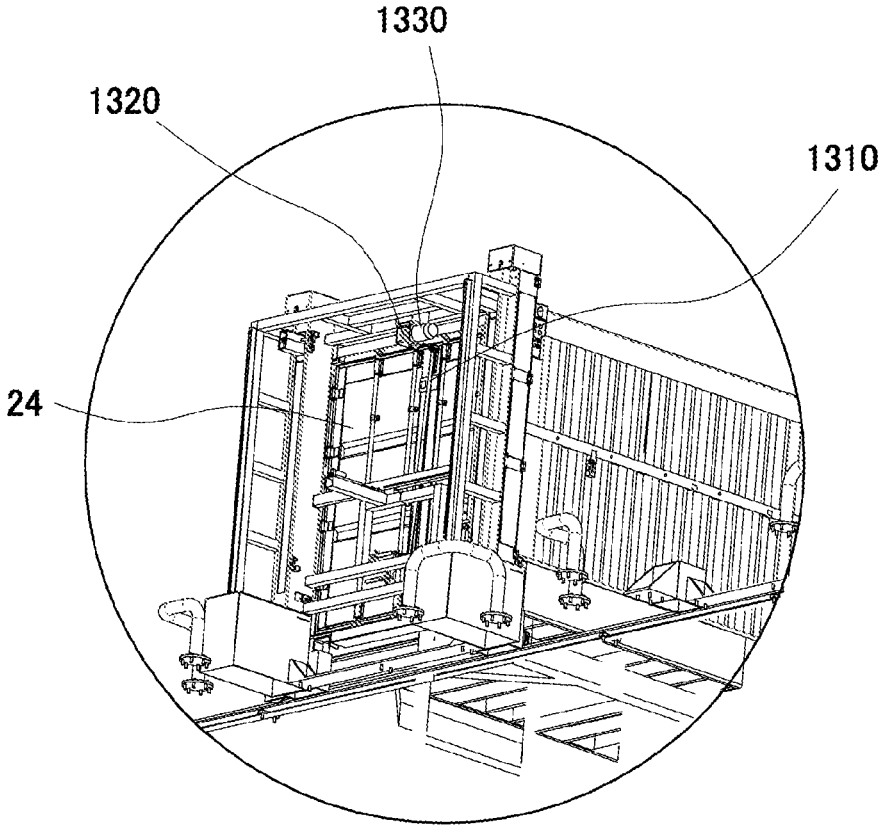
FIGS. 12 to 16 are views for explaining a method of folding a foldable container by using the foldable container folding device according to an embodiment of the present disclosure.
Figure 13:
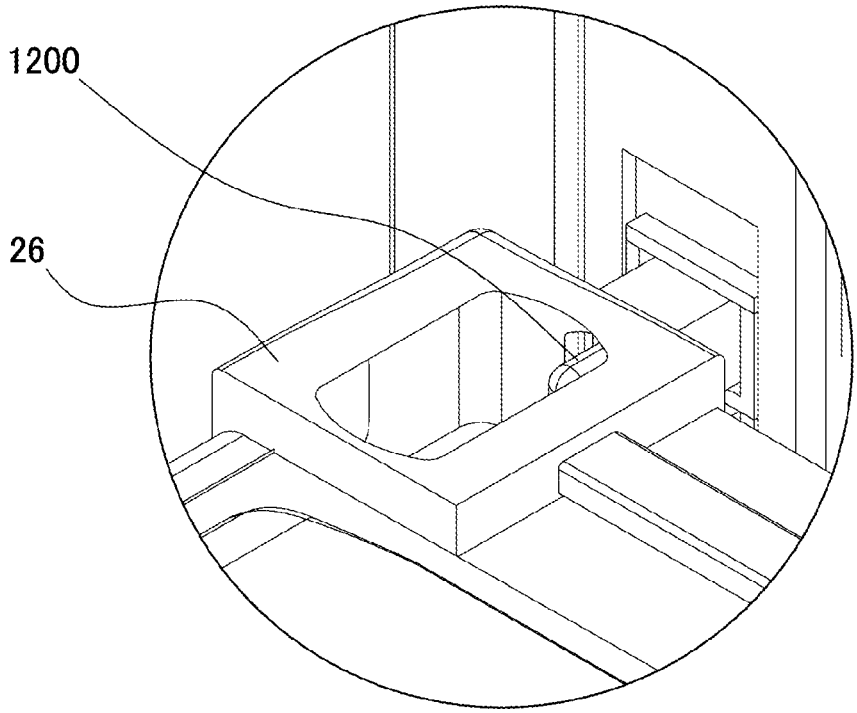

First, referring to FIGS. 12 and 13, the foldable container 20 is moved to the operation unit 200 by using the transfer unit 500, the foldable container folding device 1000 are respectively located on the front and rear surfaces of the foldable container 20, and then the upper fixing unit 1200 may be inserted into the insertion groove formed in the upper corner fitting 26 of the foldable container 20.

Next, referring to FIGS. 8 and 9, the ring fixing portion 1313 of the front and rear panel fastening rod 1310 is inserted into the ring 28 of the front panel 24 or the rear panel 25 to be fixed, and the wire may be connected to the wire fixing portion 1314 of the front and rear panel fastening rod 1310.

Next, the upper fixing unit 1200 is moved in the upward direction by a predetermined distance, and thereby the upper panel 22 and the side panel 23 may be moved by a predetermined distance in the upward direction.

Figure 14:
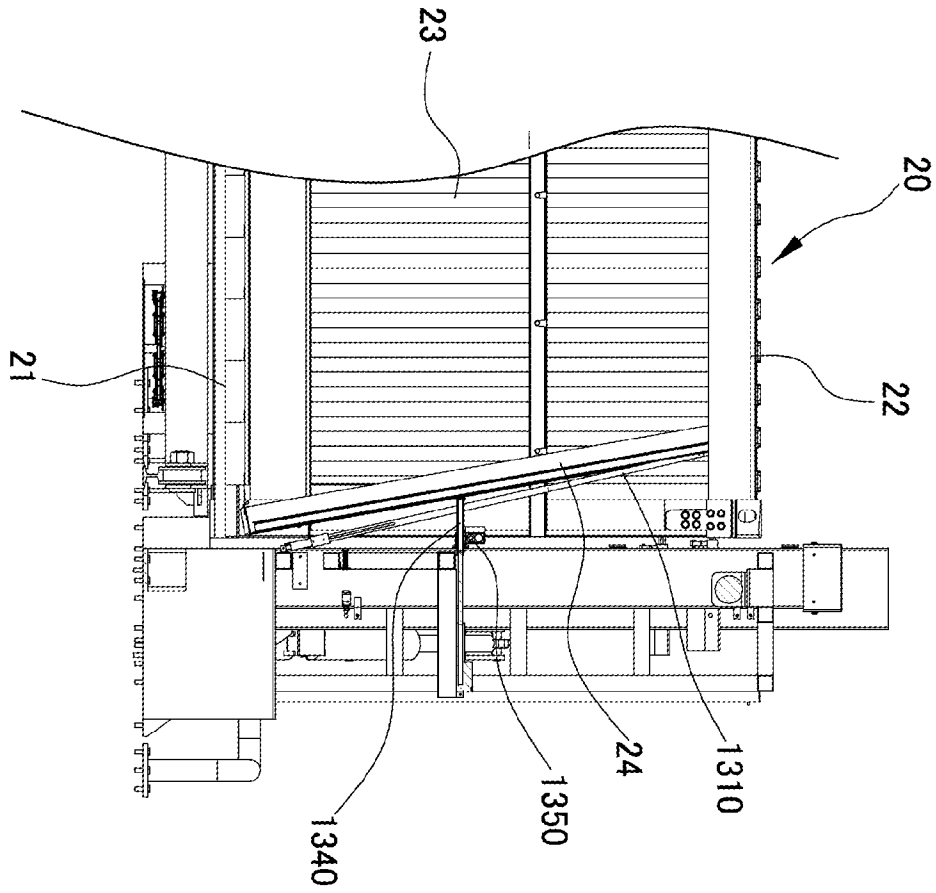

Next, referring to FIGS. 8 and 14, the front panel 24 or the rear panel 25 may be folded by gradually unwinding the wire 1320 by using the wire motor 1330 while pushing the front panel 24 or the rear panel 25 by using the push portion 1340. At this time, as the push portion 1340 is moved to the inside of the foldable container 20, the side support formed to extend in the lateral direction is also moved in the inward direction, and the length thereof is increased in the lateral direction. Therefore, the push portion 1340 comes into surface contact with the side panel 23 to prevent the side panel 23 from being suddenly folded in the inward direction. When the upper panel 22 and the side panel 23 are moved by a predetermined distance in the upward direction, as described in detail in Korean patent registration No. 10-1754192, the upper side panel may be moved upward along a sliding joint which connects the upper side panel and the lower side panel.

Figure 15:
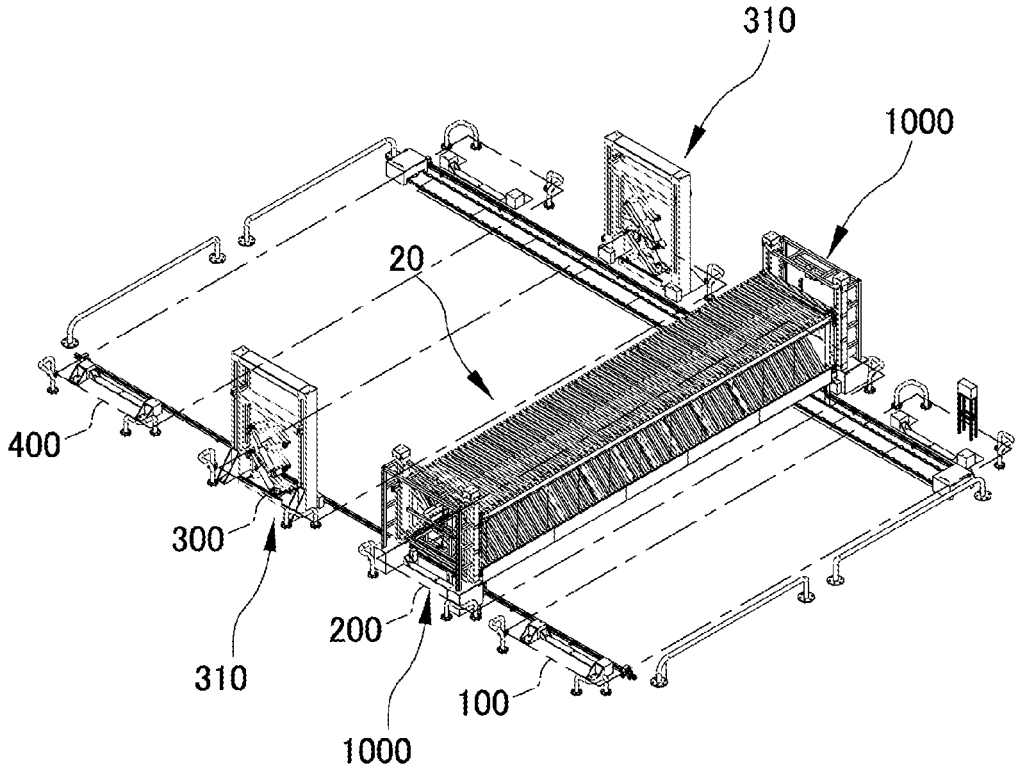

Next, referring to FIG. 15, the upper fixing unit 1200 is moved in the downward direction to move the upper panel 22 in the downward direction. At this time, the upper side panel and the lower side panel of the side panel 23 are folded in the inward direction of the foldable container 20. Specifically, the upper side panel is hinged to the upper panel 22, rotates about a portion hinged to the upper panel 22, and thereby the upper side panel may be folded in the inward direction of the foldable container 20. The lower side panel rotates about a portion hinged to the lower panel 21, and thereby lower side panel may be folded in the inward direction of the foldable container 20.

Figure 16:
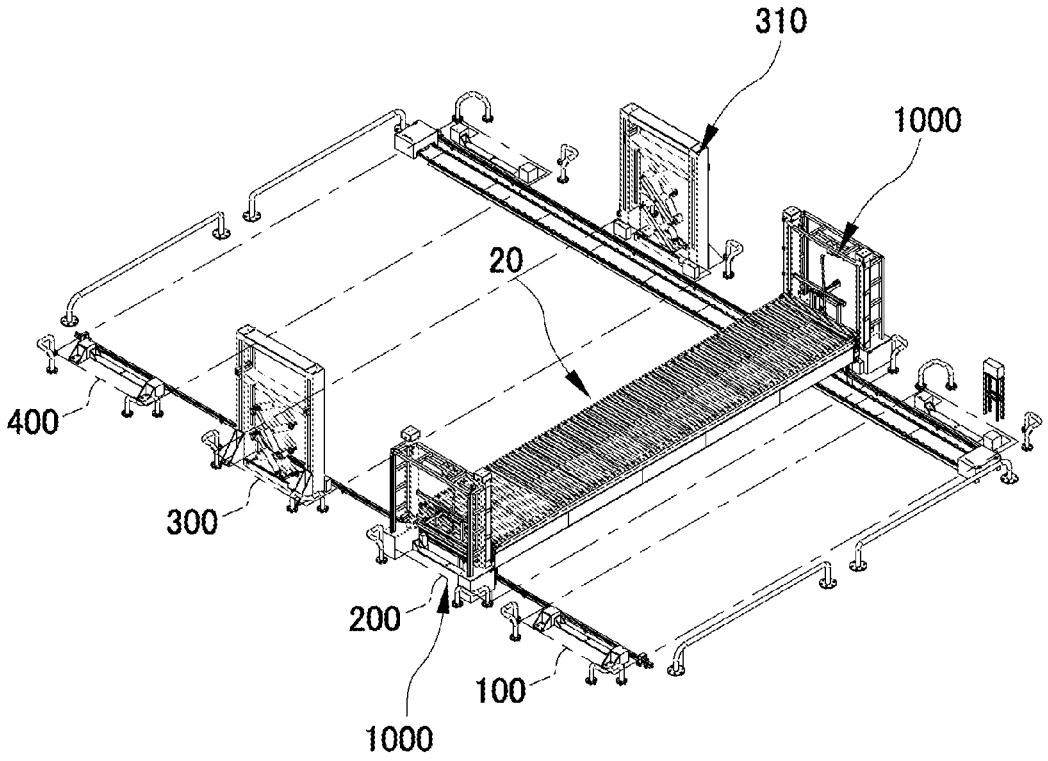

In addition, referring to FIG. 16, after the foldable container 20 is completely folded, an upper reinforcing piece of the upper corner fitting 26 and a lower reinforcing piece of the lower corner fitting 27 are coupled together through a fastening member, and thereby the folded foldable container 20 may be fixed so as not to be unfolded.

Figure 17:
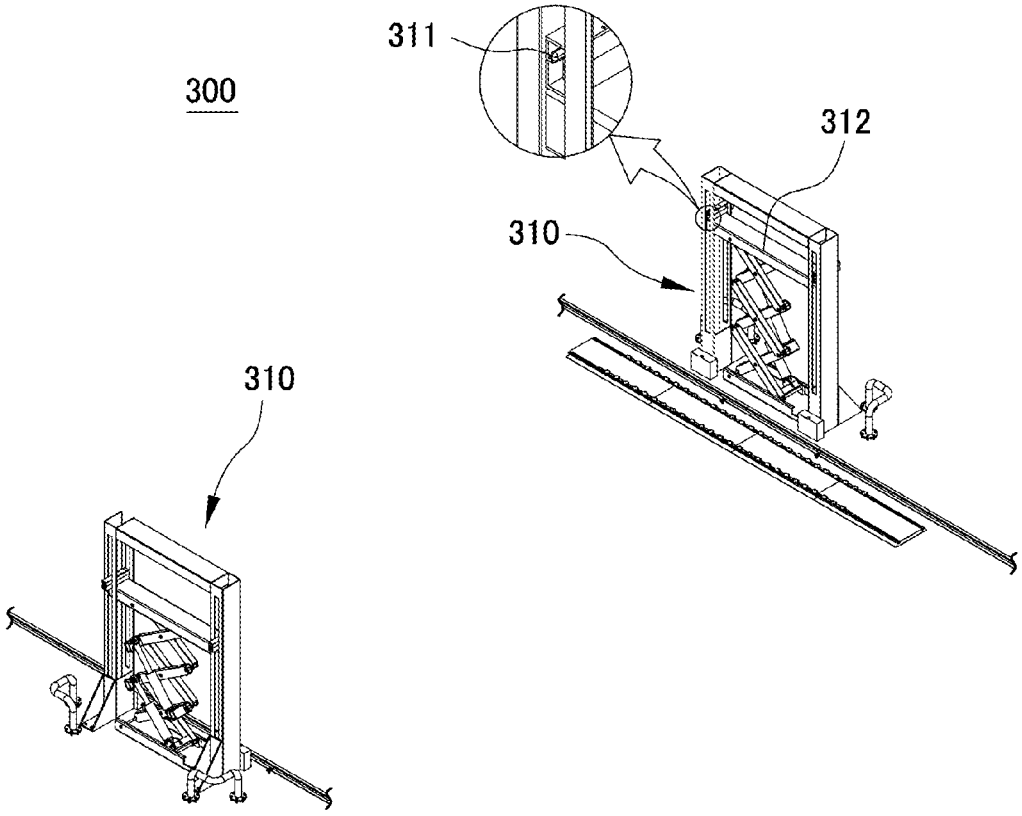
FIG. 17 is a view for explaining a locking unit according to an embodiment of the present disclosure.

Referring to FIGS. 1 and 17, the locking unit 300 is located on the left side of the operation unit 200, stacks the foldable containers 20 folded in the operation unit 200, and performs the locking operation to make the folded foldable containers 20 in one bundling unit. One bundle unit described above may mean a unit in which four folded foldable containers 20 are stacked, but is not limited thereto, and may be 3 or less, or 5 or more.

In detail, in the locking unit 300, the folded foldable containers 20 vertically stacked may be coupled by using the container elevation devices 310 which are respectively located on the front and rear surfaces of the folded foldable container 20 to lift and lower the folded foldable containers 20 after folding.

To this end, the container elevation device 310 may include an elevation fixing portion 311 which is inserted into the insertion hole of the upper corner fitting 26 or the lower corner fitting 27 of the foldable container 20; and an elevation driver 312 which lifts and lowers the elevation fixing portion 311 to lift and lower the folded foldable container 20.

Figure 18:
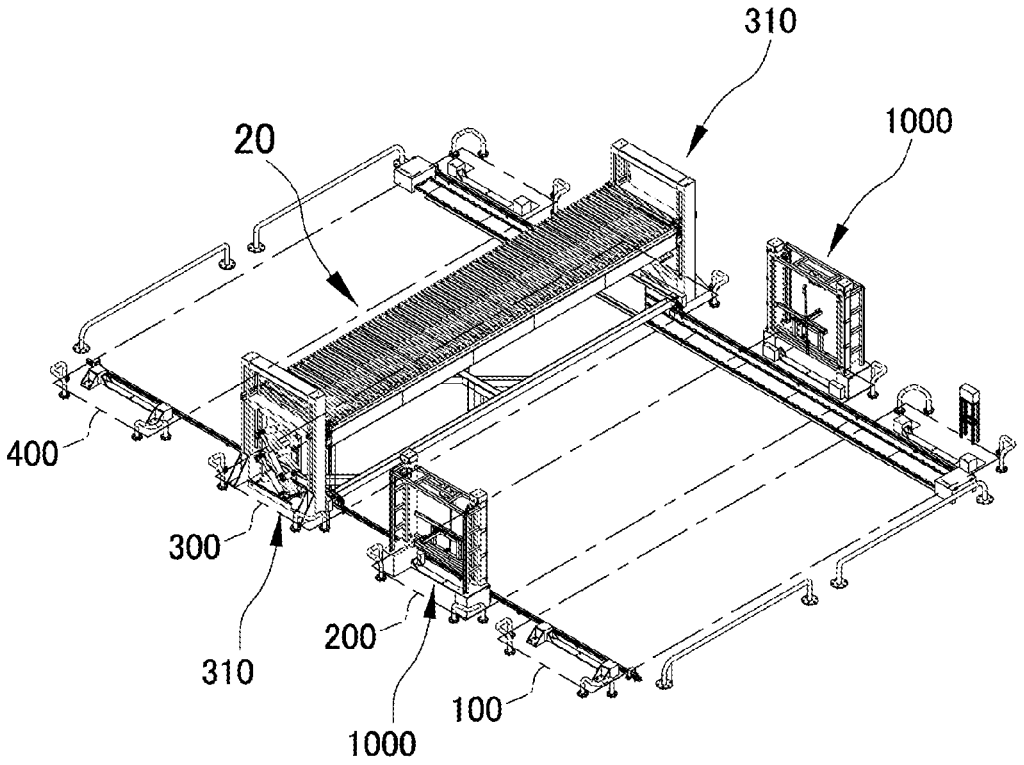
FIGS. 18 and 19 are views for explaining a method of locking a plurality of foldable containers by using a locking unit according to an embodiment of the present disclosure.
Figure 19:
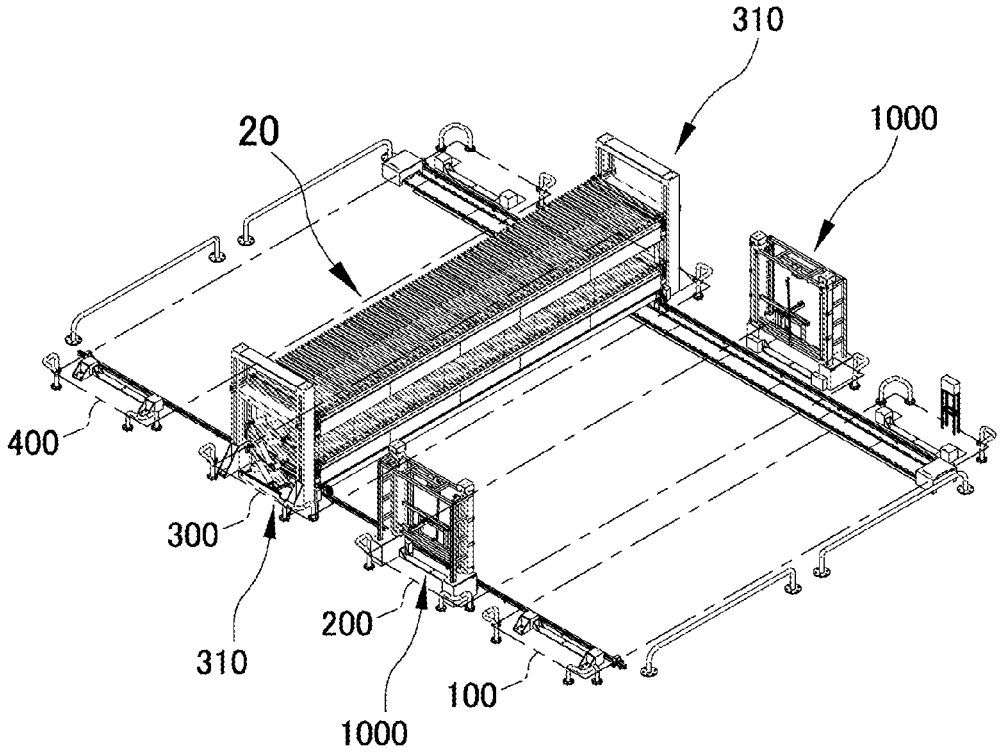

In other words, referring to FIG. 18, in the locking unit 300, the elevation fixing portion 311 is inserted into the corner fitting of the folded foldable container 20, and then the folded foldable container 20 is moved in the upward direction through the elevation driver 312. Therefore, a space, in which another folded foldable container 20 may be transferred, may be formed under the folded foldable container 20. Thereafter, referring to FIG. 19, when the other folded foldable container 20 is transferred, the container locking device is inserted between the lower corner fitting 27 of the folded foldable container 20 located at the upper portion and the upper corner fitting 26 of the folded foldable container 20 located at the lower portion to lock the folded foldable containers 20 together. In this way, the plurality of folded foldable containers 20 may be stacked in one bundle type by the container locking device.

Referring to FIG. 1, the discharge unit 400 is located at the leftmost side of the foldable container folding device 1000, and may be a waiting space for movement by a reach stacker, which is a transport equipment of the plurality of foldable containers 20 in the bundle unit. In other words, when the plurality of foldable containers 20 in the bundle unit are transferred directly from the locking unit 300 via transfer equipment, the container elevation device 310 is at risk of damage by the transfer equipment. Therefore, the separate discharge unit 400 for the plurality of foldable containers 20 may be provided to improve the stability.

Figure 20:
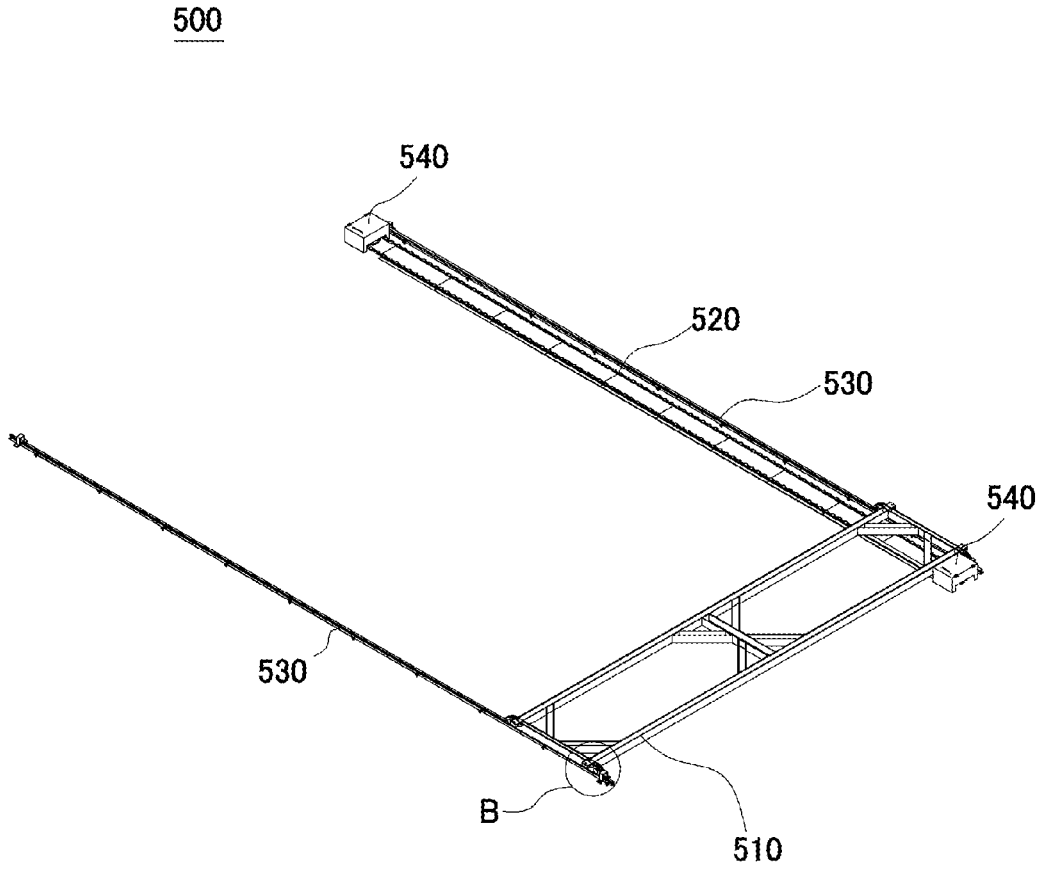
FIG. 20 is a view for explaining a transfer unit according to an embodiment of the present disclosure.

Referring to FIG. 20, the transfer unit 500 may include a rail portion 530 installed along the introduction unit 100, the operation unit 200, the locking unit 300, and the discharge unit 400; a transfer frame 510 moving the foldable container 20 along the rail portion 530; a transfer chain 520 coupled to the transfer frame 510; and a transfer driver 540 for moving the transfer chain 520.

Figure 21:
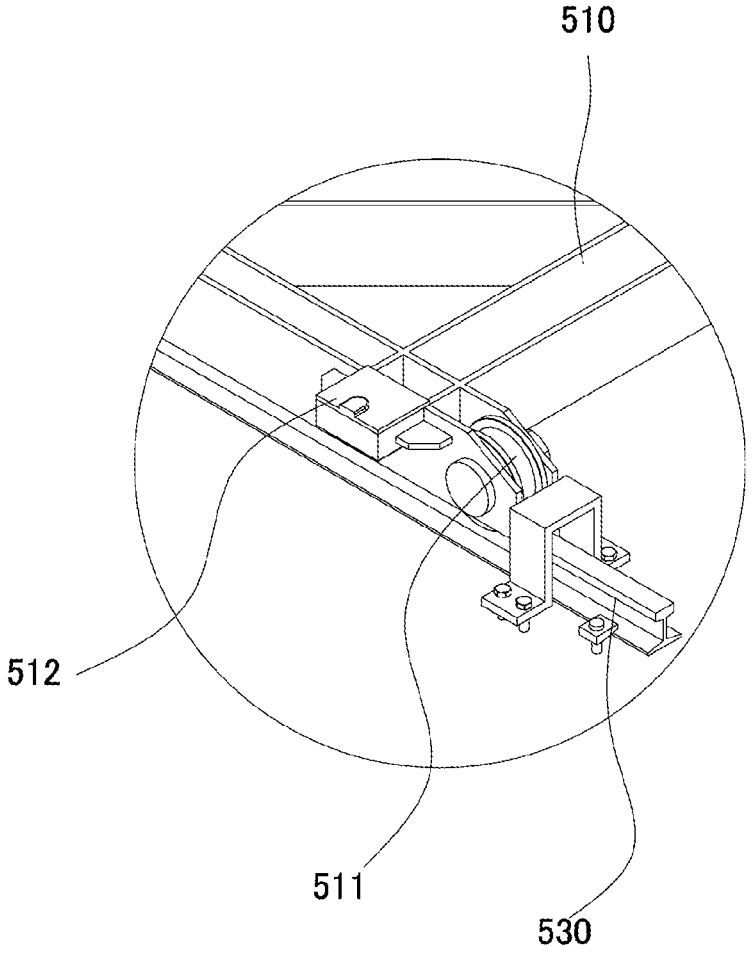
FIG. 21 is an enlarged view of portion B of FIG. 20.
Figure 22:
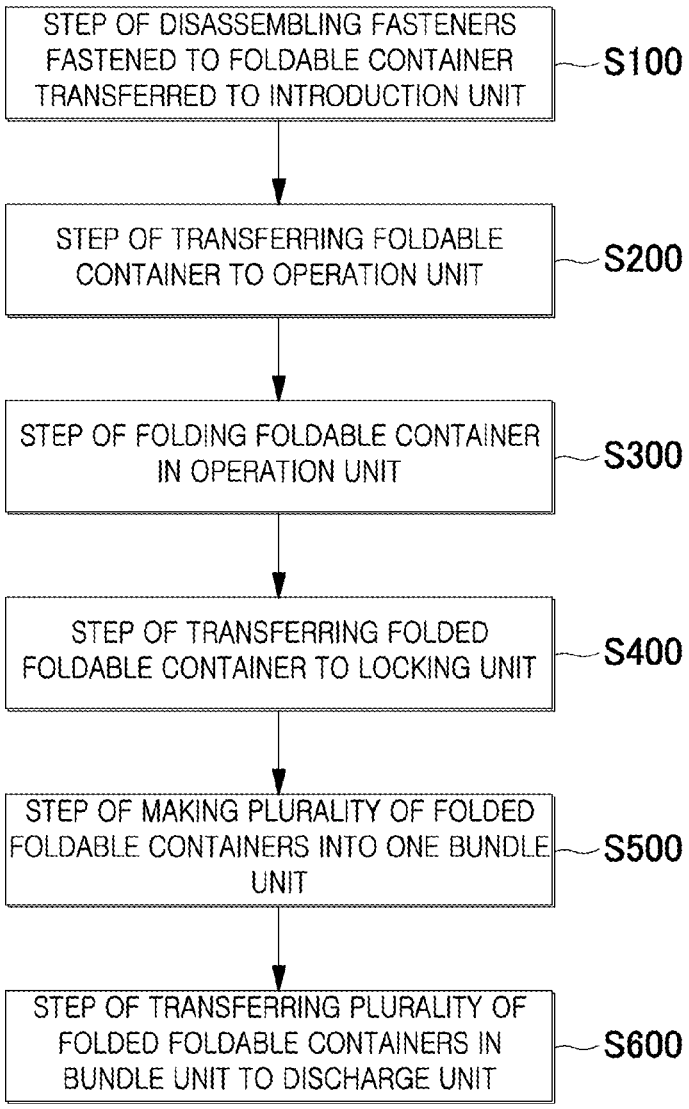
FIG. 22 is a flowchart illustrating a method of folding the foldable container by using the foldable container automatic folding system according to an embodiment of the present disclosure.

Referring to FIG. 21, the transfer frame 510 may include transfer wheels 511 which are respectively located at the corners and roll along the rail portion 530; and seating portions 512 which are respectively located at the corners and on which the lower corner fittings 27 of the foldable container 20 are seated. In other words, the foldable container 20 is seated on the upper portion of the transfer frame 510 and then the transfer frame 510 may be moved along the rail portion 530, as the transfer chain 520 is moved through the transfer driver 540.

In this case, referring again to FIG. 2, in order to examine the characteristics of the seating portion 512, the introduction unit 100, the operation unit 200, the locking unit 300, and the discharge unit 400 may include a plurality of supports 110 on which the lower corner fittings 27 of the foldable container 20 are respectively seated. In addition, the plurality of supports 110 may be located such that only an outside portion of the lower corner fittings 27 is mounted, and the rest portion of the lower corner fittings 27 may be located on the seating portion 512 of the transfer frame 510. In addition, the transfer unit 500 may further include a frame vertical driver (not illustrated) for moving the transfer frame 510 in the vertical direction.

In detail, the transfer unit 500 moves the transfer frame 510 in the upward direction, so that the corner fittings of the foldable container 20 are separated from the support 110, and then the foldable container 20 may be moved in the lateral direction. In addition, when the foldable container 20 arrives at any one selected from the introduction unit 100, the operation unit 200, the locking unit 300, and the discharge unit 400, the transfer unit 500 moves the foldable container 20 in the downward direction, so that the lower corner fittings 27 of the foldable container 20 may be seated on the support 110. Accordingly, the transfer unit 500 may improve efficiency by reducing unnecessary space and equipment.

Hereinafter, a method of folding the foldable container 20 by using the foldable container automatic folding system 10 according to an embodiment of the present disclosure will be described with reference to FIGS. 22 to 26.

In step S100, the fasteners fastened to the foldable container which is transferred to the introduction unit 100 are disassembled.

Figure 23:
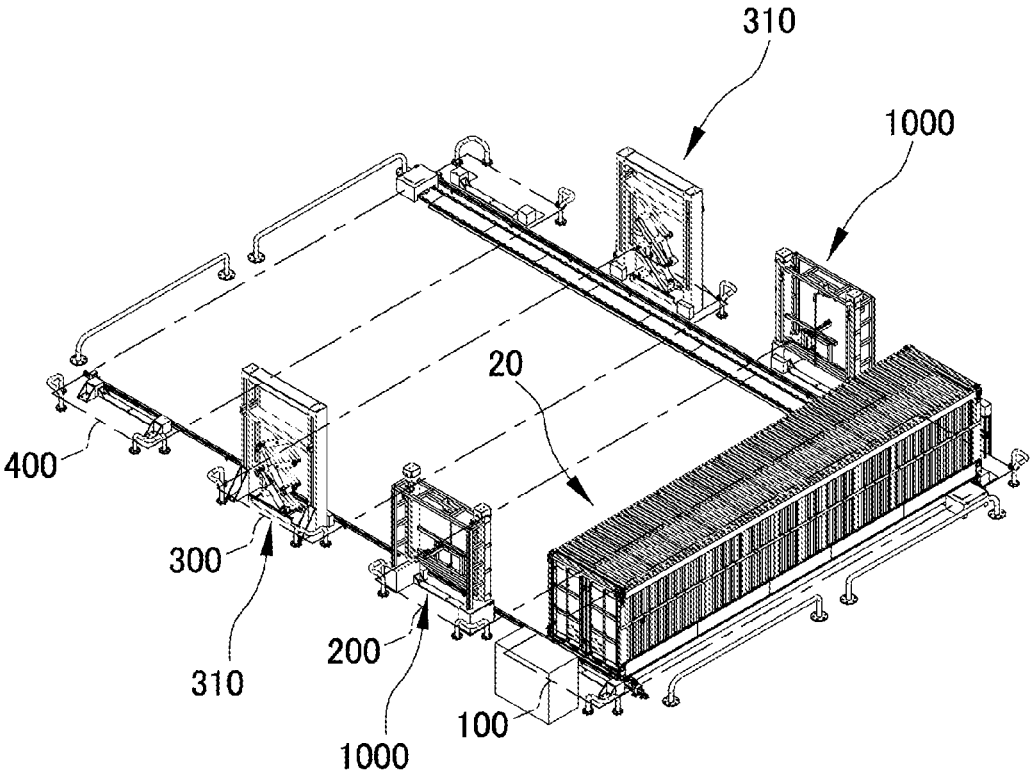
FIGS. 23 to 26 are views for explaining a method of folding the foldable container by using the foldable container automatic folding system according to an embodiment of the present disclosure.
Figure 24:
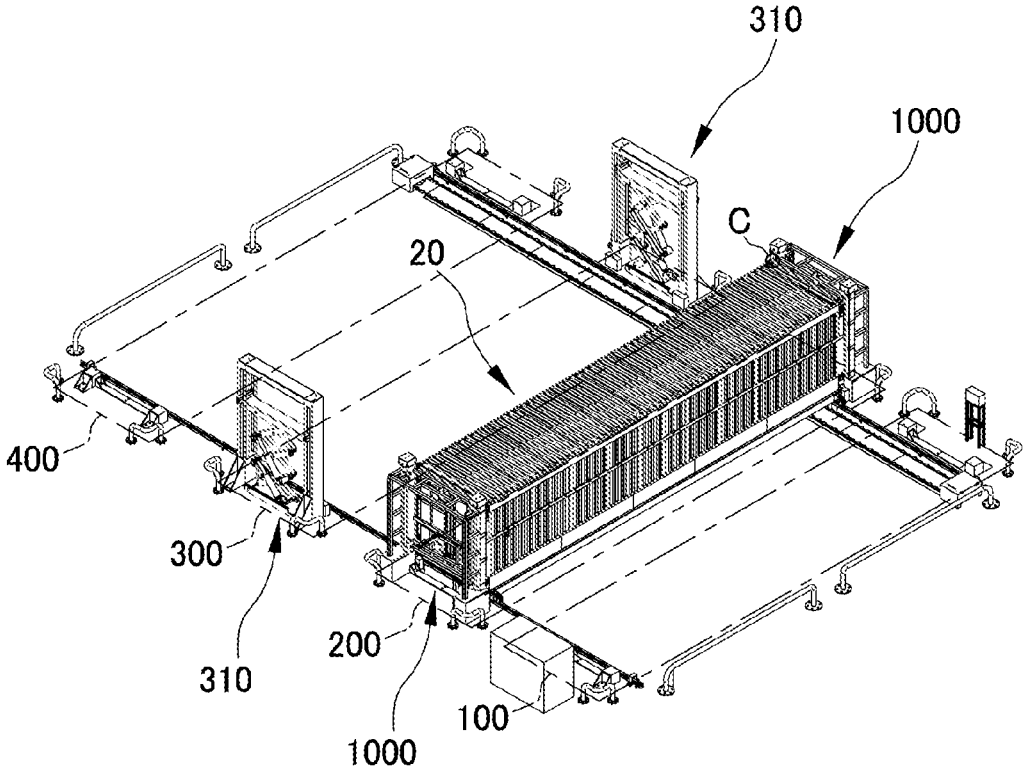

In other words, referring to FIG. 23, when the foldable container 20 is located on the support 110 of the introduction unit 100 by using a forklift or a reach stacker, the operator may disassemble the fasteners such as bolts inside and outside the foldable container 20 for keeping the unfolded state of the foldable container 20.

In step S200, the foldable container 20 is transferred to the operation unit 200.

In other words, the transfer frame 510 moves in the upward direction, and the lower corner fittings 27 of the foldable container 20 are separated by a predetermined distance in the upward direction from the support 110 of the introduction unit 100, and then the container 20 is moved to the leftward direction. Therefore, the foldable container 20 obtained by dismantling the fasteners may be located on the operation unit 200 (see FIG. 24).

In step S300, the foldable container 20 is folded in the operation unit 200.

Specifically, step S300 may include a step of connecting the front and rear panel fastening rods 1310 to the rings 28 on the upper portions of the front and rear panels 24 and 25 of the foldable container 20 (see FIG. 12); a step of inserting the upper fixing unit 1200 into the upper corner fitting 26 of the foldable container 20 (see FIG. 13); a step of moving the upper panel 22 and the side panel 23 of the foldable container 20 in the upward direction by a predetermined distance; a step of folding the front and rear panels 24 and 25 in the inward direction of the foldable container 20 by using the push portion 1340 (see FIG. 14); and a step of lowering the upper panel 22 in the downward direction (refer to FIG. 15). In this case, the step of moving the upper panel 22 and the side panel 23 in the upward direction by a predetermined distance is described in detail in Korean patent registration No. 10-1754192, which is introduced above, and is a step of being executed by a structure in which the front and rear panels 24 and 25 may be folded inside the container when the upper side panels are upwardly moved along the sliding joint which connects the upper and lower side panels. In addition, in the step of lowering the upper panel 22 in the downward direction, the upper side panel and the lower side panel of the side panel 23 may be folded inside the foldable container 20.

In addition, after the foldable container 20 is completely folded, the upper reinforcing piece of the upper corner fitting 26 and the lower reinforcing piece of the lower corner fitting 27 are coupled through via fastening member, so that the folded foldable container 20 may not be unfolded.

In step S400, the foldable container 20, which is folded in the operation unit 200, is transferred to the locking unit 300.

In other words, the transfer frame 510 located on the operation unit 200 moves in the upward direction so that the lower corner fittings 27 of the foldable container 20 are spaced a predetermined distance from the support 110 of the operation unit 200, After that, the transfer frame 510 may be moved to the leftward direction so as to move the folded foldable container 20 to the locking unit 300 to be located.

In step S500, the container locking device is inserted into the corner fittings of the foldable container 20 to form the plurality of foldable containers 20 into one bundle unit.

Figure 25:
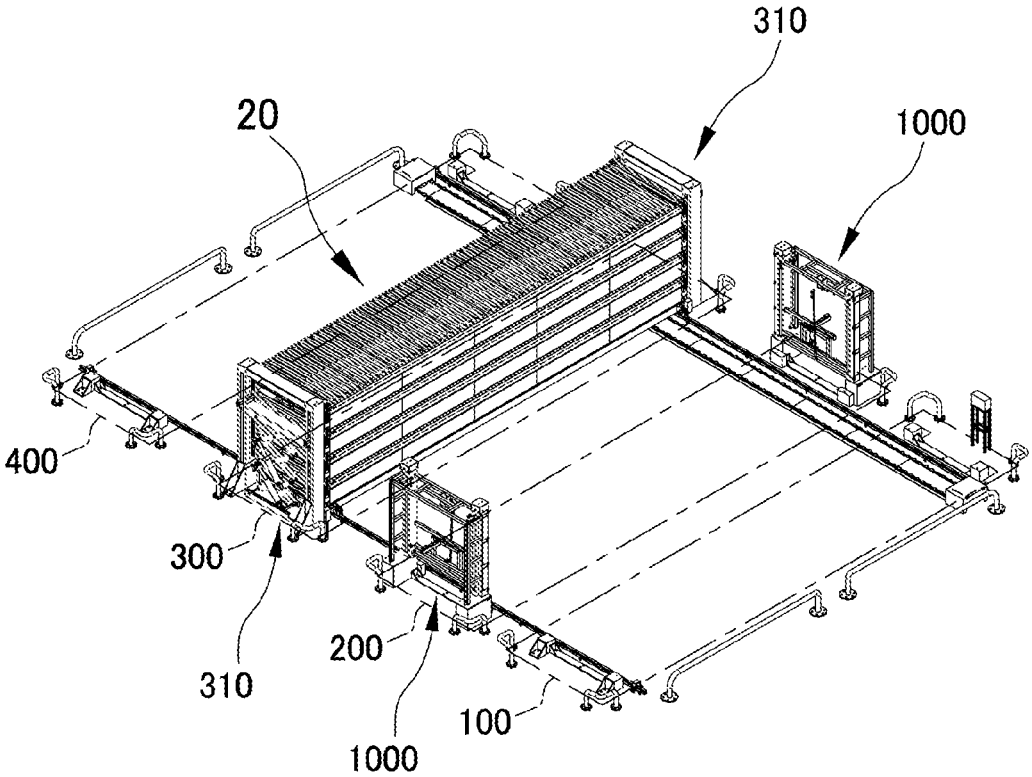

Specifically, the step S500 may include a step of inserting the elevation fixing portion 311 into the corner fitting of the folded foldable container 20; a step of transferring the folded foldable container 20 in the upward direction (see FIG. 18); a step of transferring another folded foldable container 20 to the lower portion of the folded foldable container 20 (see FIG. 19); and a step of coupling the folded foldable containers 20 together by inserting the container locking device into the lower corner fitting 27 of the folded foldable container 20 and the upper corner fitting 26 of the other folded foldable container 20. At this time, in step S500, as illustrated in FIG. 25, by repeatedly performing such lifting and lowering operations, and coupling operation by of the container locking device, four foldable containers 20 may be stacked, but is not limited thereto, and three or less, or five or more foldable containers 20 may be stacked.

Figure 26:
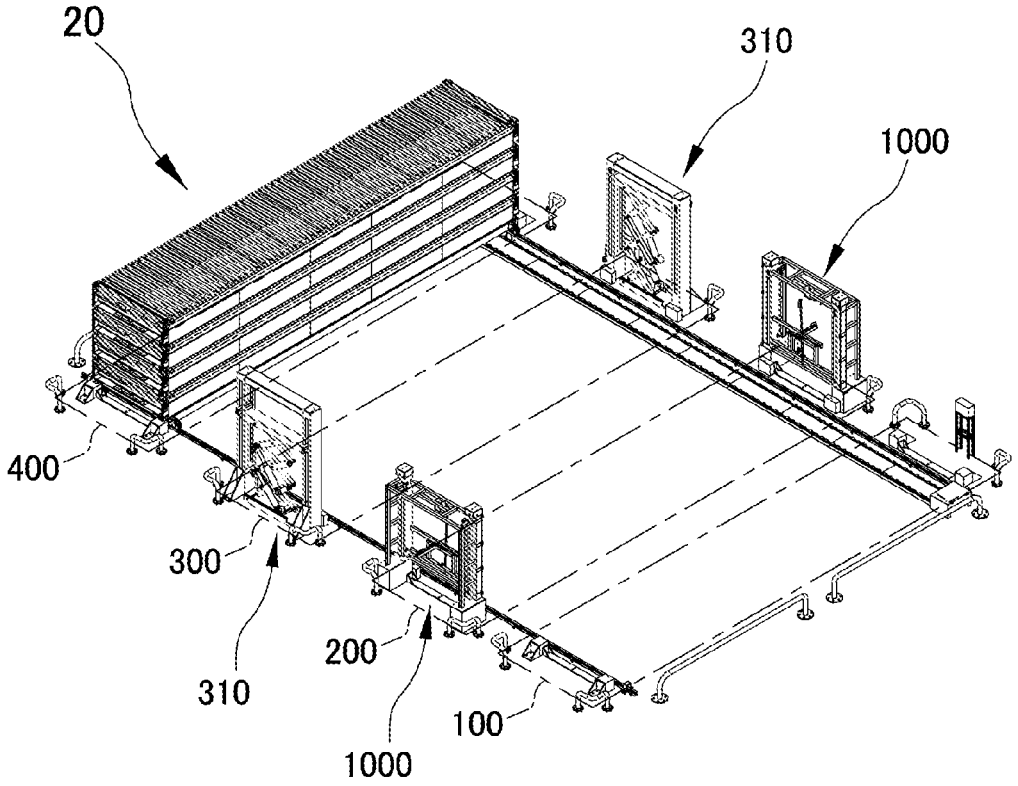

In step S600, referring to FIG. 26, the plurality of foldable containers 20 in the bundle unit made in the locking unit 300 are transferred to the discharge unit 400.

In other words, the transfer frame 510 located in the locking unit 300 moves in the upward direction so that the lower corner fittings 27 of the foldable container 20 are spaced a predetermined distance from the support 110 of the locking unit 300, and then the transfer frame 510 moves in the leftward direction. Thus, the plurality of foldable containers 20 in the bundle unit may be moved to the discharge unit 400 to be located. In addition, the plurality of foldable containers 20 in the bundle unit transferred to the discharge unit 400 may be transferred to the outside by equipment such as the reach stacker.

In the above, the process of folding and stacking the foldable containers 20 is described, and the plurality of foldable containers 20 are unfolded in the opposite order when unfolding.

On the other hand, in order to more firmly fasten the plurality of folded foldable containers 20 in the bundle unit, a separate fastening device may be fastened. For example, the plurality of folded foldable containers 20 may be coupled by coupling a protrusion, which is inserted into a hole of each corner fitting, to a rigid body formed to extend along the corner fittings of the plurality of folded foldable containers 20.

The foregoing description of the present application is for illustrative purposes only, and those of ordinary skill in the art to which the present application pertains will be able to understand that other specific forms may be easily modified without changing the technical spirit or essential features of the present application. Therefore, it should be understood that the embodiments described above are illustrative in all respects and not limiting. For example, each component described as a single type may be implemented in a distributed manner, and similarly, components described as being distributed may also be implemented in a combined form.

The scope of the present application is indicated by the claims to be described later rather than detailed description, and all changes or modified forms derived from the meaning and scope of the claims and their equivalent concepts should be construed as being included in the scope of the present application.

DESCRIPTION OF SYMBOLS

10: foldable container automatic folding system
100: introduction unit, 110: support
200: operation unit
300: locking unit, 310: container elevation device
311: elevation fixing portion, 312: elevation driver
400: discharge unit
500: transfer unit
510: transfer frame, 511: transfer wheel
512: seating portion, 520: transfer chain
530: rail portion, 540: transfer driver
20: foldable container
21: lower panel, 22: upper panel
23: side panel, 24: front panel
25: rear panel, 26: upper corner fitting
27: lower corner fitting
1000: foldable container folding device
1100: main body
1200: upper fixing unit
1300: front and rear opening/closing unit
1310: front and rear panel fastening rod, 1311: upper fastening rod
1312: lower fastening rod, 1313: ring fixing portion
1314: wire fixing portion
1320: wire, 1330: wire motor
1340: push portion, 1350: side support
1400: elevation opening/closing unit, 1410: elevation wire
1420: elevation driver, 1430: pulley
1440: ball screw
1500: wheel

What is claimed is:

1. A foldable container folding device that is located at each of a front and a rear of a foldable container, and folds or unfolds the foldable container, comprising:

a main body;

an upper fixing unit provided on an upper portion of the main body and fixing an upper portion of the foldable container;

front and rear opening/closing units provided on the upper portion of the main body to open and close a front panel or a rear panel of the foldable container; and an elevation opening/closing unit for elevating an upper panel and a side panel of the foldable container by elevating the upper fixing unit, wherein the front and rear opening/closing unit includes a front and rear panel fastening rod, the front and rear panel fastening rod having an upper end to be connected to a ring of the front panel or the rear panel and a lower end rotatably coupled to a lower portion of the main body, wherein the front and rear panel fastening rod includes:

an upper fastening rod;

a lower fastening rod into which the upper fastening rod is inserted, and of which a lower end is rotatably coupled to the lower portion of the main body;

a wire fixing portion located on an upper portion of the upper fastening rod and to which a wire is connected; and a ring fixing portion located on the upper portion of the upper fastening rod to be fixed to the ring of the front panel or the rear panel, and wherein the upper fastening rod is coupled to the lower fastening rod to be extended or contracted in a longitudinal direction of the front and rear panel fastening rod.

2. The foldable container folding device of claim 1, wherein the front and rear opening/closing unit includes:

a wire connected to an upper end of the front and rear panel fastening rod; and a wire motor for winding or unwinding the wire.

3. The foldable container folding device of claim 1, wherein the upper fixing unit is configured to be inserted into an insertion groove located on a side of the upper panel of the foldable container.

4. The foldable container folding device of claim 1, wherein the upper fixing unit is configured to be inserted into an insertion groove located at the front or the rear of the upper panel of the foldable container.

5. The foldable container folding device of claim 1, wherein the upper fixing unit moves in a longitudinal direction of the elevation opening/closing unit.

6. The foldable container folding device of claim 1, wherein the front and rear opening/closing unit further includes:

a push portion configured to push the front panel or the rear panel toward the inside of the foldable container; and a side support extending in a lateral direction from the push portion and configured to adjust a length thereof in the lateral direction.

7. The foldable container folding device of claim 1, wherein the elevation opening/closing unit includes:

a pulley located inside the main body and at an upper portion of the main body;

an elevation wire having one end connected to the upper fixing unit via the pulley; and an elevation driver located at a lower portion of the main body and winding or unwinding the elevation wire.

8. The foldable container folding device of claim 7, wherein the elevation opening/closing unit further includes:

a ball screw that is rotated by the elevation driver and connected to the elevation wire to lift and lower the upper fixing unit via the elevation wire and the pulley.

9. The foldable container folding device of claim 1, wherein a plurality of wheels are provided at a lower portion of the main body.

* * * * *